US012391434B1

(12) United States Patent
Christopher

(10) Patent No.: US 12,391,434 B1
(45) Date of Patent: Aug. 19, 2025

(54) STORAGE COMPARTMENT BOX WITH SELF-ALIGNING BINS

(71) Applicant: Meridian International Co., Ltd., Shanghai (CN)

(72) Inventor: Brent Christopher, Centennial, CO (US)

(73) Assignee: Meridian International Co., Ltd, Shanghai (CN)

( * ) Notice: Subject to any disclaimer, the term of this patent is extended or adjusted under 35 U.S.C. 154(b) by 0 days.

(21) Appl. No.: 18/187,901

(22) Filed: Mar. 22, 2023

(51) Int. Cl.
*B65D 25/08* (2006.01)
*B65D 25/06* (2006.01)

(52) U.S. Cl.
CPC ..... *B65D 25/08* (2013.01); *B65D 25/06* (2013.01)

(58) Field of Classification Search
CPC ..... B65D 77/0446; B65D 2543/00518; B65D 25/04; B25H 3/021
USPC ..... 220/23.87, 23.88
See application file for complete search history.

(56) References Cited

U.S. PATENT DOCUMENTS

2009/0162506 A1* 6/2009 Weir ..... A47J 47/10 426/396
2012/0318792 A1* 12/2012 Larson ..... B25H 3/02 220/23.88
2013/0024468 A1* 1/2013 Kocsis ..... B65D 53/00 220/23.88

* cited by examiner

*Primary Examiner* — Jeffrey R Allen
(74) *Attorney, Agent, or Firm* — Eversheds Sutherland (US) LLP

(57) ABSTRACT

A plurality of removable bins are positionable in the interior area of the base each of which comprising a bottom surface, a plurality of sidewalls extending upward from the bottom surface to create a first storage area, a chamfer extending upward and outward from each of the sidewalls to be engaged by the lid to move the bin into alignment.

8 Claims, 9 Drawing Sheets

STORAGE COMPARTMENT BOX WITH SELF-ALIGNING BINS

TECHNICAL FIELD

This disclosure relates to storage devices, and, more specifically, this disclosure relates to a storage device with self-aligning bins.

BACKGROUND INFORMATION

Storage compartment boxes or portable organizers have been used for separating and storing a wide variety of items such as documents, parts, tools and equipment. In one form, storage cases have been developed as portable, transportable, hand held types of storage boxes that are made of light weight molded plastic. The portable storage box generally includes a handle for carrying, with a dual hinged clear plastic top that can be secured by two locking tabs on the handle side of the case. These storage boxes have been modified with a variety of different dividers or compartments to permit separation and organization of the contents.

A problem with these storage boxes is keeping contents confined to the bins. Gaps in the dividers or between the bin and the lid allow parts to escape the bins and intermingle defeating the purpose of a portable storage box.

Accordingly, there is a need for an improved portable storage box with bins that self-align with the lid to prevent mixing of the contents and provide more storage capacity.

SUMMARY

In accordance with one aspect of the present invention, a storage container is provided. The storage container has a base comprising an interior area. A plurality of removable bins are positionable in the interior area of the base each of which comprising a bottom surface, a plurality of sidewalls extending upward from the bottom surface to create a first storage area, and a chamfer extending upward and outward from each of the sidewalls. A lid is pivotally combined to the base comprising a plurality of second storage areas defined by a plurality of extending sidewalls projecting downward from the inside of the lid each of which plurality of extending sidewalls is configured to align with the chamfer of the plurality of bins to urge the bin into alignment, wherein the second storage area and the first storage area sum together to create a total storage area for the bin.

In an embodiment, the step in the bin comprises a ledge extending substantially perpendicular from the sidewall away from a center of the bin and a vertical riser extending upward from the ledge to a beginning of the chamfer. A top ridge beginning at a top of the chamfer extends outward from the center of the bin.

In an embodiment, structure for hanging the bins outside the storage container can be provided. A downward member can extend downward from the top ridge of at least one side of the bin. A gap can be provided between the sidewall of the bin and the downward member for hanging the bin. Also, a pair of cutouts in the downward member for hanging the bin can be provided.

In another embodiment, the bin comprises a ledge at the top of the sidewalls extending perpendicularly outward from the center of the bin. The chamfer extends downward and outward from the ledge. A downward member extending downward from the chamfer of at least one side of the bin. A gap between the sidewall of the bin and the downward member for hanging the bin and a pair of cutouts in the downward member for hanging the bin.

In yet another embodiment, the bin comprises of a depression arranged at each corner of the bin which depression comprises the chamfer circumscribing the inner diameter of the depression. The lid further comprises a peg aligned with each depression of the bin wherein the peg comprises one of the plurality of extending sidewalls that aligns with the chamfer.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
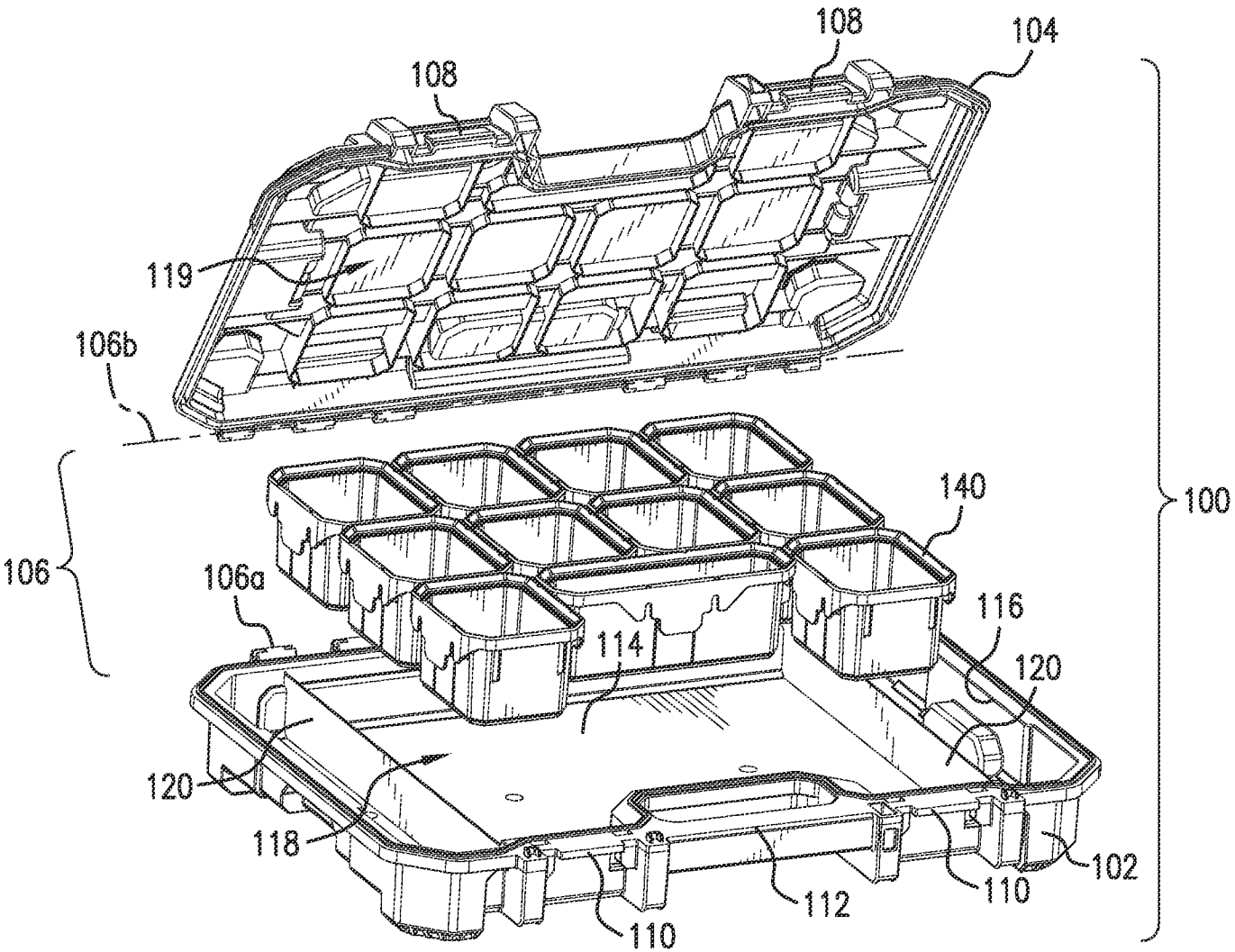
FIG. 1 is an exploded view of the portable storage box according to this disclosure.

Referring to FIG. 1, shown is an exploded view of a portable storage container 100 according to this disclosure. Storage container 100 comprises of a base 102 with a lid 104 that is movably coupled to base 102 to move between an open position and a closed position. In the illustrated embodiment, lid 104 is pivotally coupled to base 102 by a hinge 106, which can be implemented in various ways but in the illustrated embodiment comprises of a plurality of cylindrical connectors 106*a* joined side-by-side by a rod 106*b*. Lid 104 includes one or more cover latches 108 to releasable secure lid 104 in the closed position to corresponding mating lugs 110 on base 102. A handle 112 is provided on base 102 for carrying.

More specifically, base 102 comprises of a bottom surface 114 and sidewalls 116 extending from bottom surface 114 defining an interior area 118. Interior area 118 can have one or more removable dividers 120 that mate in corresponding longitudinal channels on opposing sides of sidewalls 116. These removable dividers allow the for a wide variety of customization of interior area 118. Interior area 118 has a depth "D" from bottom surface 114.

Figure 3:
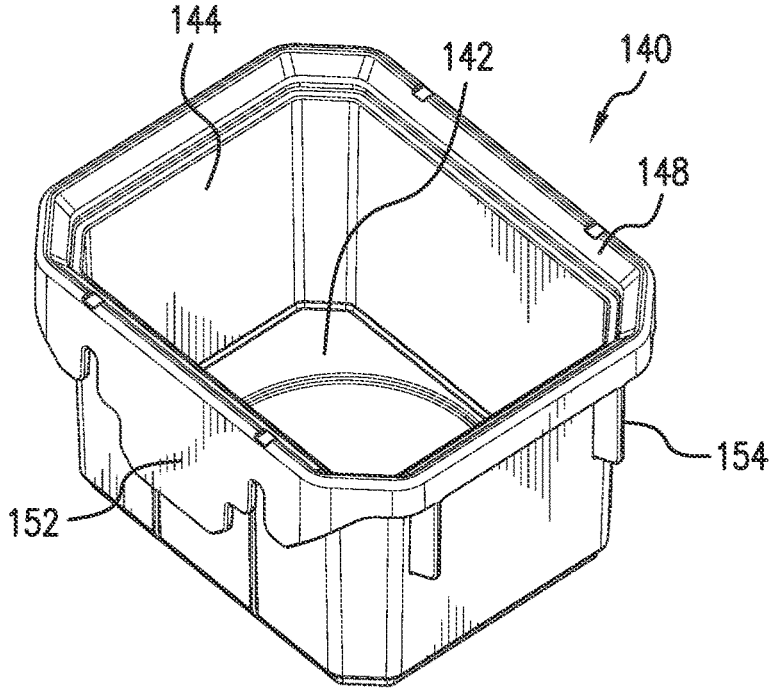
FIG. 3 is a perspective view of a bin found in the storage box of FIG. 1.
Figure 4:
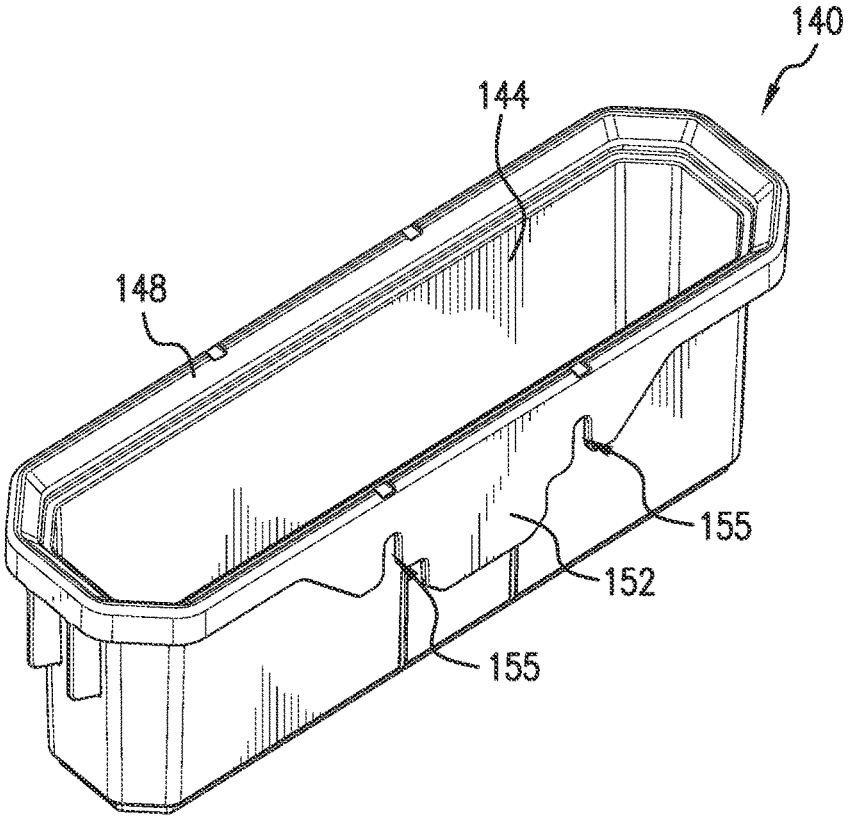
FIG. 4 is a perspective view of another embodiment of a bin according to this disclosure.
Figure 5:
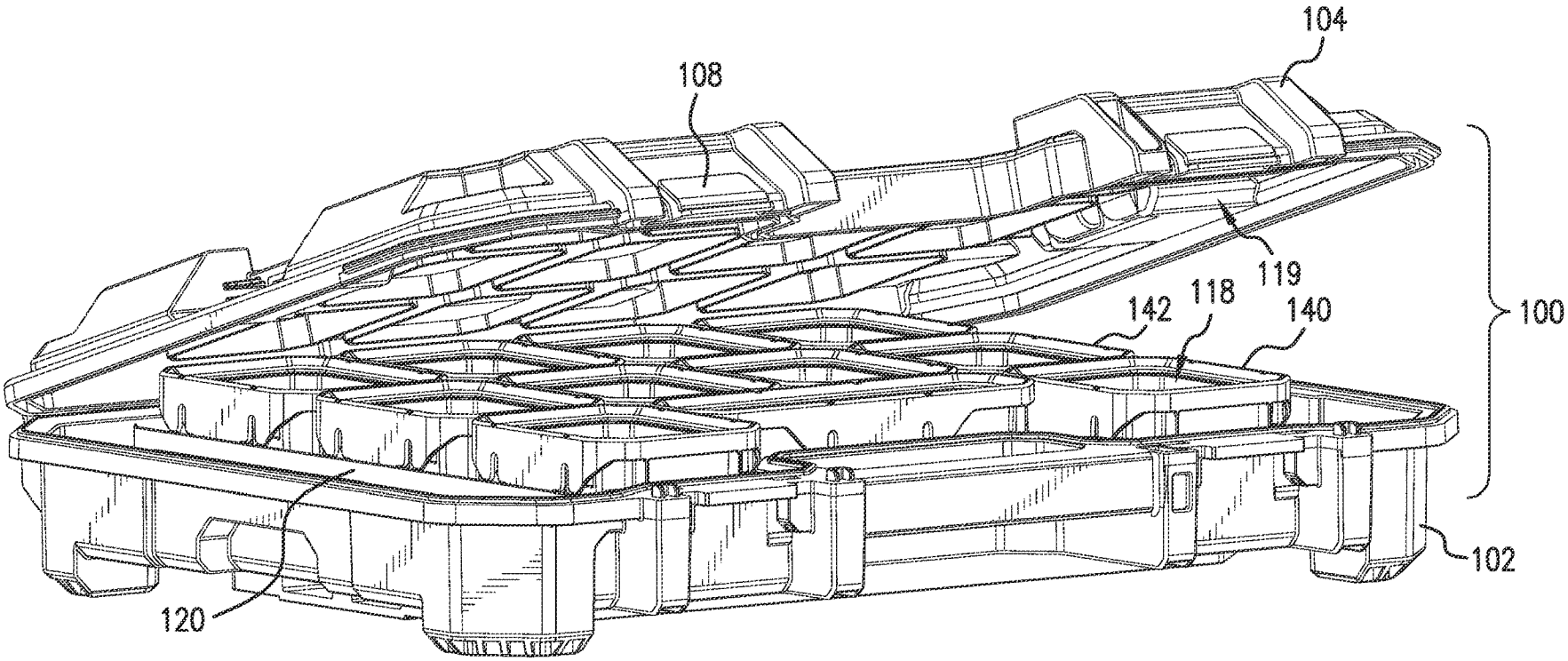
FIG. 5 is a perspective view of the portable storage box with the lid partially closed.

Turning to FIG. 3, shown are perspective views of bin 140 positioned in base 102 of storage container 100. Bins 140 are generally rectangular or square shaped when viewed from the top (but may be any other shape, e.g., round, triangular, pentagonal, octagonal etc.). Preferably, they are sized to maximize the number of bins 140 that fit into interior area 118 of base 102. For example, a rectangular bin 140 may be twice the length of the square bin and ½ the width, as shown in FIG. 3. Bins 140 are then arranged in a grid pattern inside interior area 118, as shown in FIG. 1. Bins 140 are preferably made from plastic but can be made of any material.

Figure 7:
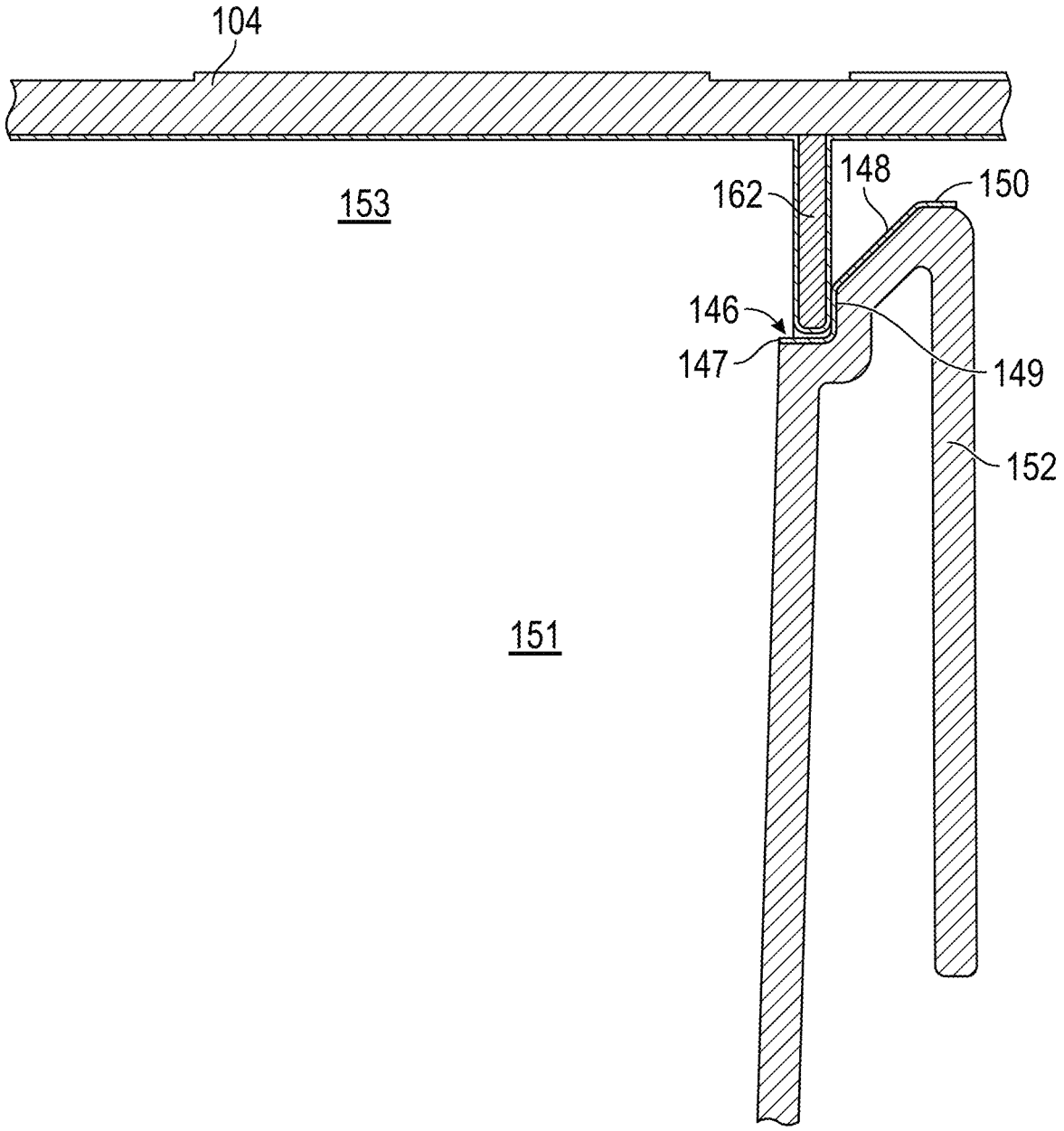
FIG. 7 is an exploded, cross-sectional view of the portable storage box of this disclosure showing the lid interacting with the bin.

Bins 140 comprise a bottom surface 142 and four sidewalls 144 extending upward from bottom surface 142. The angel between sidewalls 144 and bottom surface 142 can be perpendicular or have an acute or obtuse taper upward to define a storage area. Turning to FIG. 7, near the top of each of sidewalls 144 is an outward indexing step 146 comprising a ledge 147 parallel to bottom surface 142 and a vertical riser 149 that leads to a chamfer 148 to a top ridge 150. The space in bin 140 from bottom surface 142 to ledge 147 of step 146 is a first storage area 151 and the space from ledge 147 to the top inside surface of lid 104 is a second storage areas 153. Together first storage area 151 and second storage area 153 comprise a total storage area.

A downward member 152 extends perpendicularly downward from top ridge 150 parallel and spaced apart from sidewall 144. One or more gussets 154 can be positioned on the outside of sidewalls 144 to brace top ridge 150. Together downward member 152 and gusset 154 set off the sides of respective bins 140 from each other and provide the proper spacing between bins 140.

Downward member 152 is also configured to hang off a rim. This allows bin 140 to be removed from storage container 100 and located somewhere else for convenience. Downward member 152 is also designed with a pair of cutouts 155 sized to hang bin 140 from a pair of hangers, screws, nails, or the like; for example, for hanging bins 140 on peg boards. This allows bins 140 to be used separate from storage container 100 for easy access to small parts and then placed in storage container 100 for travel.

Figure 2:
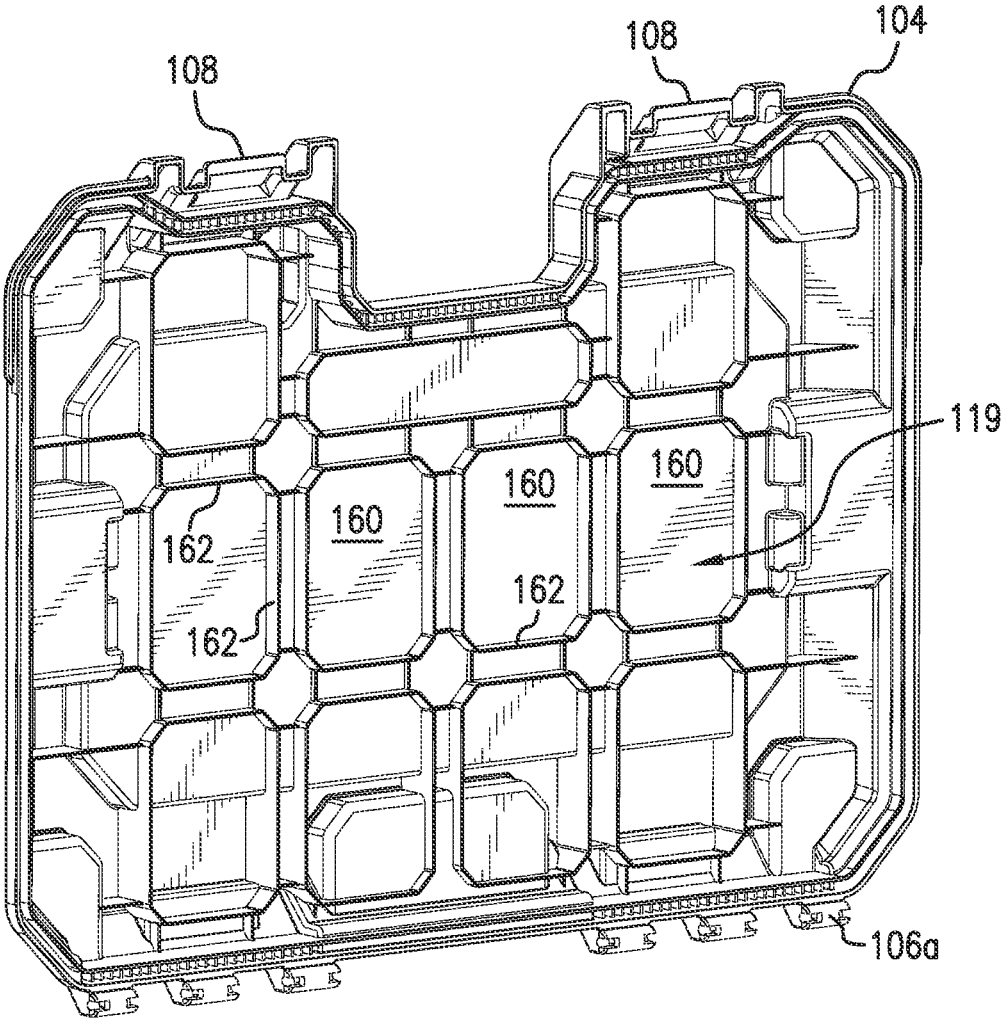
FIG. 2 is a perspective view of the underside of the lid of the storage box of FIG. 1.

Turning back to FIG. 2, show is a perspective view of lid 104. Lid 104 has a plurality of second storage areas 153 that are configured to align with bins 140 such that second storage area 153 of lid 104 and first storage area 151 of bins 140 sum to create the interior storage area for each bin 140. Second storage area 153 are defined by a top inside surface 160 of lid 104 bounded by four extending sidewalls 162.

Figure 6:
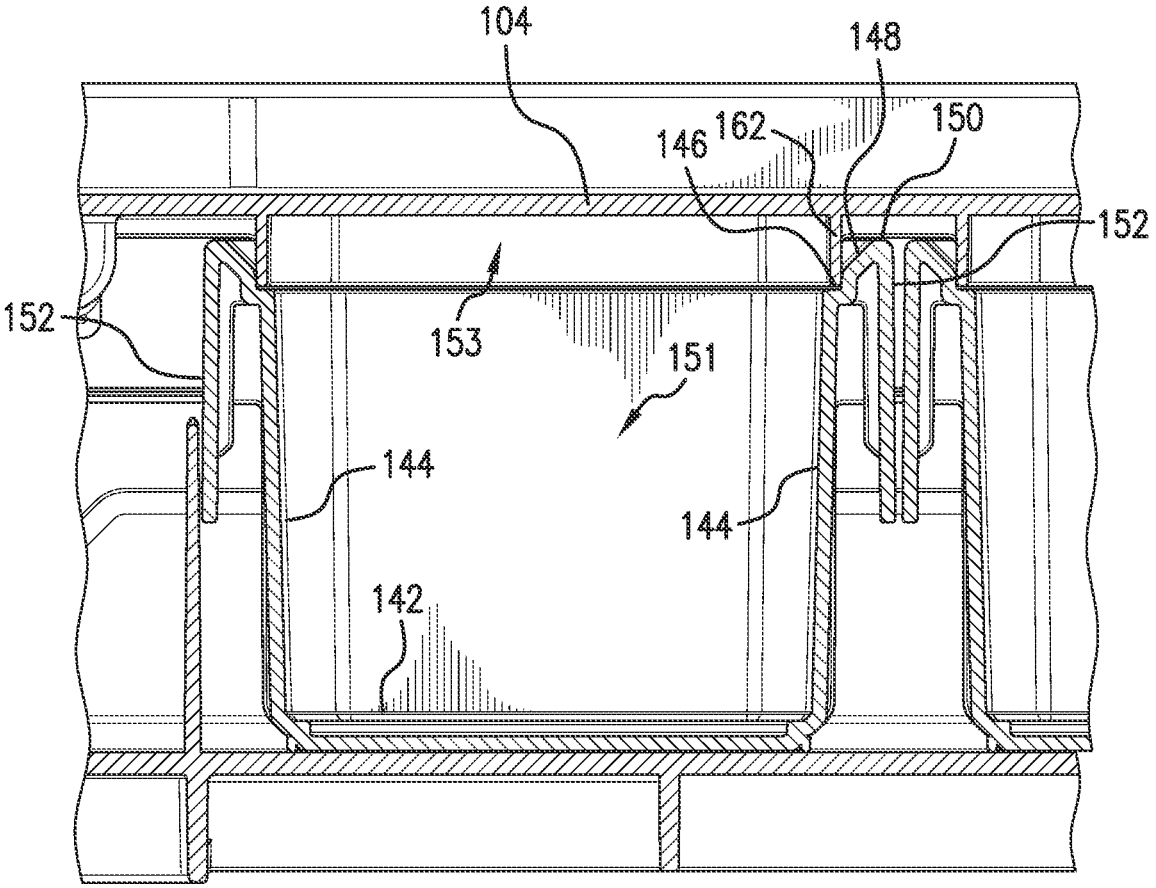
FIG. 6 is a cross-sectional view of the portable storage box of this disclosure.

Turning to FIG. 6 and FIG. 7, shown are a cross-sectional views of a closed lid 104 on base 102 to illustrate the storage area of a bin 140. As illustrated, one of each extending sidewall 162 rests on one of step 146 internal of bin 140. This interaction creates a single storage area for bin 140 comprising of second storage area 153 of lid 104 and first storage area 151. This allows the user to first storage area 151 of bin 140 above capacity and still close storage area off to prevent the spillage of contents inside bin 140.

In operation, bins 140 are positioned inside base 102. Downward member 152 provides a gross alignment of each bin 140 with respect to protruded interior areas 119 of lid 104. As lid 104 is closed, extending sidewall 162 engages chamfer 148 on bin 140 to urge bin 140 into alignment so that second storage area 153 of lid 104 and first storage area 151 of bin 140 are aligned.

Figure 8:
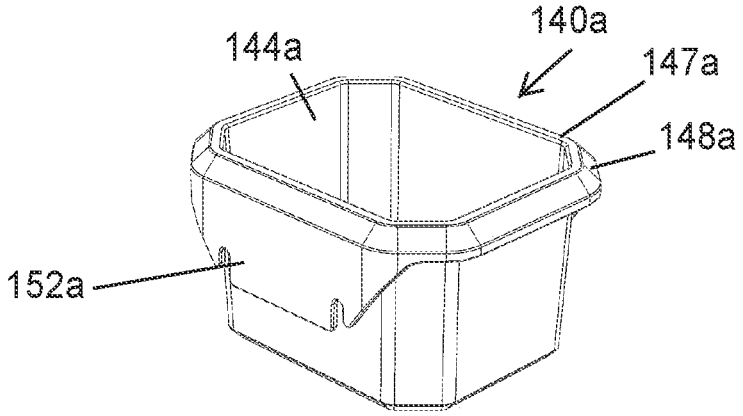
FIG. 8 is another embodiment of a bin and a lid according to this disclosure.

A key feature is the use of chamfer 148 to index bins 140 into position. In this regard, chamfer 148 can take on a variety of configurations. Turning to FIGS. 7-8, shown is a bin 140*a* of a similar configuration of the foregoing. Instead, sidewalls 144*a* extend all the way upward to a ledge 147*a* that extends perpendicularly outward from center of bin 140*a*. Chamfer 148*a* then extends downward from ledge 147*a* and outward from the center of bin 140*a*. Again, a downward member 152*a* provides a gross alignment of each bin 140*a* with respect to second storage area 153*a* of lid 104*a*. As lid 104*a* is closed, extending sidewall 162*a* engages chamfer 148*a* on bin 140*a* to urge bin 140*a* into alignment so that second storage area 153*a* of lid 104*a* and first storage area 151*a* of bin 140*a* are aligned.

Figure 9:
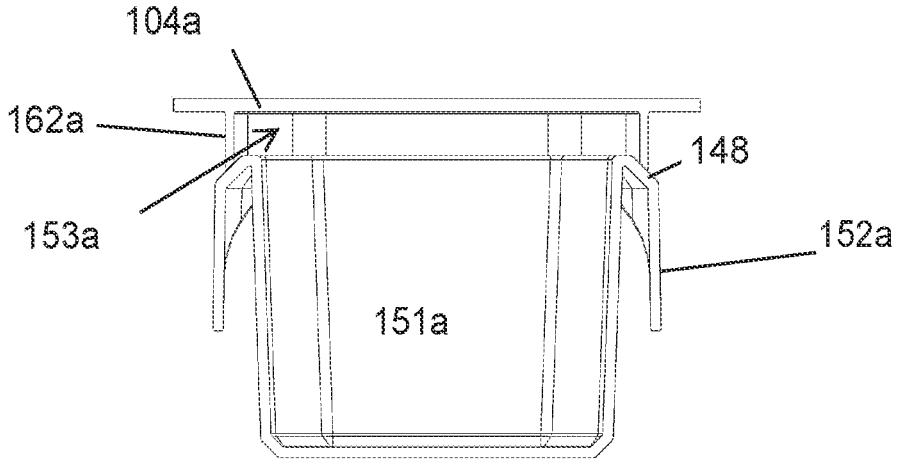
FIG. 9 shows the bin of FIG. 8 interacting with the lid.
Figure 10:
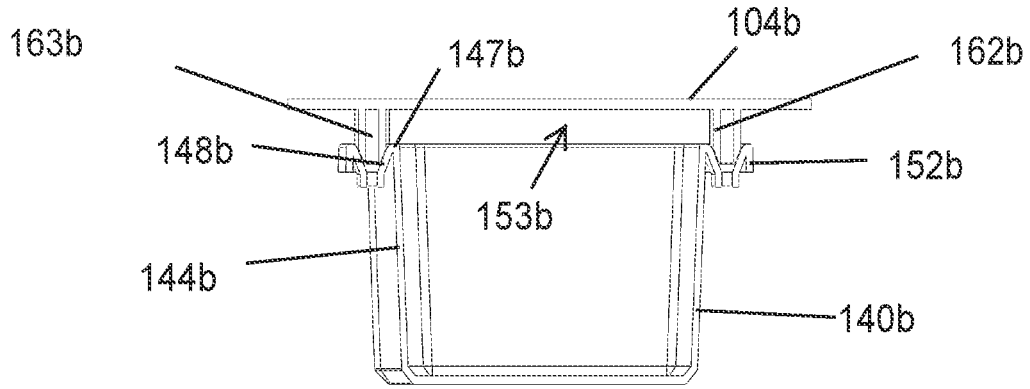
FIG. 10 is yet another embodiment of a bin and a lid according to this disclosure.
Figure 11:
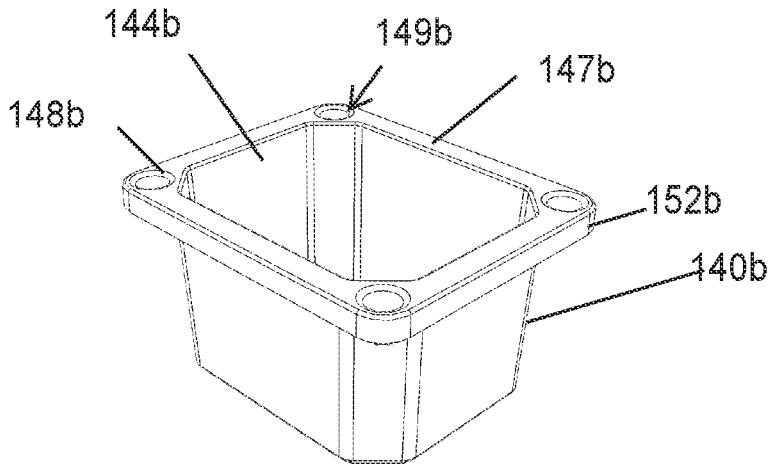
FIG. 11 is a perspective view of the bin of FIG. 10.
Figure 12:
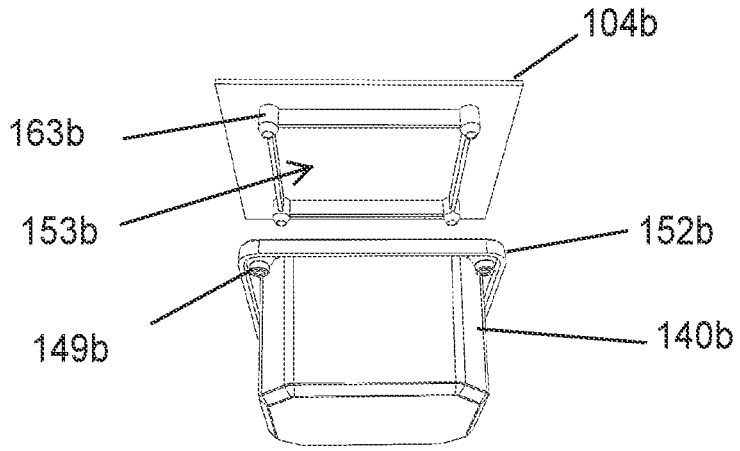
FIG. 12 a bottom-facing perspective view of the bin and lid of FIG. 10.

Turning to FIGS. 9-11, shown is another embodiment of a bin 140*b* according to this disclosure. Again, sidewalls 144*b* extend all the way upward to a ledge 147*b* that extends perpendicularly outward from center of bin 140*b*. Chamfer 148*b* is created by a round depression 149*b* in ledge 147*b* which extends downward in ledge 147*b* with chamfer 147*b* circumscribing the diameter. Again, a downward member 152*b* provides a gross alignment of each bin 140*b* with respect to second storage area 153*b* of lid 104*b*. As lid 104*b* is closed, extending sidewall 162*b* (which can be a side of a peg 163*b*) engages chamfer 148*b* on bin 140*b* to urge bin 140*b* into alignment so that second storage area 153*b* of lid 104*b* and first storage area 151*b* of bin 140*b* are aligned.

Those skilled in the art will recognize that the foregoing embodiments can take various arrangements. For example, the structure comprising the chamfer of each bin and the plurality of extending sidewalls on each lid can be reversed in each embodiment. The chamfer can be connected to the respective lid or the bin in a wide variety of ways that allows the bin to be urged into alignment with the second storage area formed in the lid so that the first storage area inside the bin positively sums with the second storage area of the lid to create a total storage area that is larger than the first storage area of the bin.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

I claim:

1. A storage container comprising:

a base comprising an interior area;

a plurality of removable bins positionable in the interior area of the base each of which comprising a bottom surface, a plurality of sidewalls extending upward from the bottom surface to create a first storage area, and a chamfer extending outward from each of the sidewalls;

a lid pivotally combined to the base comprising a plurality of second storage areas defined by a plurality of extending sidewalls projecting downward from the inside of the lid each of which plurality of extending sidewalls is configured to engage the chamfer to urge the bin into alignment so that the second storage area and the first storage area sum together to create a total storage area for the bin;

a step extending substantially perpendicular and outward from each of the sidewalls of the bin;

a ledge extending substantially perpendicular from the sidewall away from a center of the bin; and a vertical riser extending upward from the ledge to a beginning of the chamfer.

2. The storage container of claim 1, and further comprising a top ridge beginning at a top of the chamfer and extending outward from the center of the bin.

3. The storage container of claim 2, and further comprising a downward member extending downward from the top ridge of at least one side of the bin.

4. The storage container of claim 3, and further comprising a gap between the sidewall of the bin and the downward member for hanging the bin.

5. The storage container of claim 4, and further comprising a pair of cutouts in the downward member for hanging the bin.

6. The storage container of claim 1, and further comprising a plurality of dividers positionable inside the interior area of the base define an outer perimeter for the plurality of bins.

7. A storage container comprising:

a plurality of removable bins positionable in an interior area of the storage container each of which comprising a bottom surface and a plurality of sidewalls extending upward from the bottom surface to create a first storage area;

a lid for the storage container comprising a plurality of second storage areas defined by a plurality of extending sidewalls projecting downward from the inside of the lid, wherein the second storage area and the first storage area sum together to create a total storage area for the bin; and a step extending substantially perpendicular and outward from each of the sidewalls of the bin;

a ledge extending substantially perpendicular from the sidewall away from a center of the bin; and a vertical riser extending upward from the ledge to a beginning of a chamfer.

8. The storage container of claim 7, wherein the chamfer extends outward from each of the sidewalls; and wherein each of which plurality of extending sidewalls is configured to engage the chamfer to urge the bin into alignment so that the second storage area and the first storage area sum together to create a total storage area for the bin.

* * * * *